US005346209A

United States Patent [19]

Kring

[11] Patent Number: 5,346,209

[45] Date of Patent: Sep. 13, 1994

[54] SYSTEM FOR COVERING POOL AND BILLIARDS TABLES

[76] Inventor: Timothy D. Kring, 1224 Treasure Cay Ct., Punta Gorda, Fla. 33950

[21] Appl. No.: 92,723

[22] Filed: Jul. 19, 1993

[51] Int. Cl.[5] ..... A63D 15/00

[52] U.S. Cl. ..... 473/32; 473/30

[58] Field of Search ..... 473/30, 31, 32, 33, 473/4, 6, 8, 9, 11, 18, 29

[56] References Cited

U.S. PATENT DOCUMENTS

| | | | |
|---|---|---|---|
| 1,323,516 | 12/1919 | Acland | 473/31 |
| 1,725,215 | 8/1929 | Seal | 473/31 |

FOREIGN PATENT DOCUMENTS

| | | | |
|---|---|---|---|
| 2668943 | 5/1992 | France | 473/32 |
| 16191 | of 1906 | United Kingdom | 473/31 |
| 413189 | 7/1934 | United Kingdom | 473/29 |

*Primary Examiner*—Theatrice Brown
*Attorney, Agent, or Firm*—William E. Noonan

[57] ABSTRACT

A system is provided for covering the horizontal playing surface of a pool table and the elongate rail elements mounted along the edge of the pool table. A cloth cover is wrapped about an inside cushioned edge of the rail element. An upper groove is formed longitudinally in an upper surface of the rail element for receiving an upper section of the rail cover and a first spline is received in a relatively tight fit in the upper groove to hold the upper section of the rail cover therein. A lower groove is formed longitudinally in a bottom surface of the rail element and an elongate channel member is received by and attached within the lower groove for receiving a lower section of the rail cover. A second spline is received in a relatively tight fit in the channel member to hold the lower section of the rail cover therein. A cloth cover extends across the playing surface of the pool table and includes a side portion that hangs over an edge of the playing surface. A bracket is attached to a backing element carried below the playing surface. The bracket has a channel that extends in a direction generally parallel to the edge of the playing surface for receiving the side portion of the playing surface cover and a spline is received by the bracket channel in a relatively tight fit to hold the side portion of the playing surface cover therein.

15 Claims, 3 Drawing Sheets

SYSTEM FOR COVERING POOL AND BILLIARDS TABLES

FIELD OF THE INVENTION

This invention relates to a system for covering the rail segments and playing surface of a pool or billiards table.

BACKGROUND OF THE INVENTION

Most pool and billiards tables employ a felt cloth for covering the playing surface of the table, as well as the rail that borders the playing surface between the pockets. Traditionally, both the playing surface cover and the rail cover have been secured to the table by closely spaced, heavy duty staples. This technique of securing the cloth to the table is tedious and time consuming. For the playing surface alone, 250–300 staples may be required. Moreover, it is difficult and time consuming to remove and replace a cloth that has been secured to the rail or playing surface by staples. Each individual staple must be pried out of the table and then replaced to secure a new cloth.

Various known pool tables have employed wood splines to secure the cloth to the rail or table. For example, in some tables an elongate channel is routed along the top surface of the rail. An upper edge of the cloth is held in the channel by a featherstrip that is tightly fitted into the channel. Various other tables employ a spline construction for holding the cloth that covers the playing surface. In each of these known techniques, however, the channel that holds the spline is routed or otherwise formed permanently in a wooden portion of the table. As a result, if the spline is ill-fitted in the channel, the cloth is not securely held. Moreover, if the temperature and/or humidity in the room varies, a wood routed channel will tend to shrink and expand. This also tends to loosen the cloth cover.

SUMMARY OF INVENTION

It is therefore an object of this invention to provide a system for quickly, conveniently and inexpensively coveting the elongate rail elements and horizontal playing surface of a pool or billiards table.

It is a further object of this invention to provide a system for coveting pool tables that permits an old cloth cover to be removed from the table and a new cover replaced over the table in a quick and convenient manner.

It is a further object of this invention to provide a system for covering pool tables that is effective for use in both constructing a new table and recovering an old table.

It is a further object of this invention to provide a system for coveting pool and billiards tables wherein the cloth cover is held snugly in place and resists slipping and loosening, even when the table is exposed to fluctuating temperature and humidity conditions.

It is a further object of this invention to provide a system for coveting pool tables that does not require precisely routed channels.

This invention features a system for coveting the elongate rail element mounted along the edge of a pool or billiards table. The system includes a cloth cover that is wrapped about an inside, cushioned edge of the rail element and has upper and lower sections. An upper groove is formed longitudinally in an upper surface of the rail segment for receiving the upper section of the cloth. First spline means are received in a relatively tight fit in the upper groove to hold the upper section of the cover therein. A lower groove is formed longitudinally in a bottom surface of the rail element. An elongate channel member is received by and attached within the lower groove for receiving the lower section of the cover. Second spline means are received in a relatively tight fit in the channel member to hold the lower section of the cover therein.

In a preferred embodiment the first spline means include an elongate featherstrip. The channel member may have a generally U-shaped cross sectional shape and is preferably composed of metallic material. The second spline means may include an elongate elastomeric member. This elastomeric member may include a plurality of longitudinal ribs. The channel member may include a main channel and an entrance into the main channel which is narrower than the main channel.

This invention also features a system for covering the horizontal playing surface of a pool or billiards table. The system includes a cloth cover that extends across the playing surface of the table and has a side portion that hangs over an edge of the playing surface. A bracket is attached to a backing element carded below the playing surface. The bracket has a channel that extends in a direction generally parallel to the edge of the playing surface for receiving the side portion of the cloth. Spline means are received by the channel in a relatively tight fit to hold the side portion of the cloth in the channel.

The metal contained within the bracket preferably has a generally U-shaped cross sectional shape. The bracket may include a channel portion that defines the channel and a flange portion that extends laterally from the channel portion and engages at least one of the backing element and a side of the playing surface. The flange portion may include a single flange segment extending from one side of the channel portion. Alternatively, the flange portion may include a pair of flange elements extending from respective sides of the channel portion. The spline means may include an elongate elastomeric element.

This invention also features a system for covering both the elongate rail element and the horizontal playing surface in accordance with the above construction.

DETAILED DESCRIPTION OF PREFERRED EMBODIMENTS

Other objects, features and advantages will occur from the following description of preferred embodiments and the accompanying drawings, in which.

Figure 1:
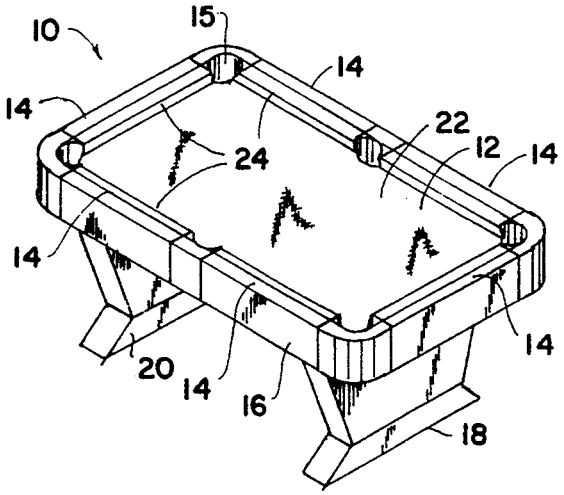
FIG. 1 is a perspective view of a pool table that includes the covering system of this invention.

There is shown in FIG. 1 a pool or billiards table 10, which employs the covering system of this invention. Table 10 features a horizontal playing surface 12 that is bounded by six rail elements 14. Although three slightly different rail configurations are featured (two adjacent side rails and an end rail), the principles of this invention apply equally to each rail element and therefore a single numerical designation is employed. Each pair of rail elements is separated by and attached to a conventional billiards pocket 15. A skirt 16 depends from the rail segments in a conventional manner that is described more fully below. A pair of legs 18 and 20 support horizontal playing surface 12, again in a known manner. The specific structural details of table 10 itself, aside from the covering system, are standard and should be known to those skilled in the art.

Horizontal playing surface 12 normally includes a planar piece of slate that is covered by a cloth material 22. Separate and distinct pieces of cloth 24 cover the inner cushioned edges of each rail element 14. The manner of attaching cloth pieces 22 and 24 to the playing surface 12 and rails 14, respectively, constitutes the present invention, which features the following construction.

Figure 2:
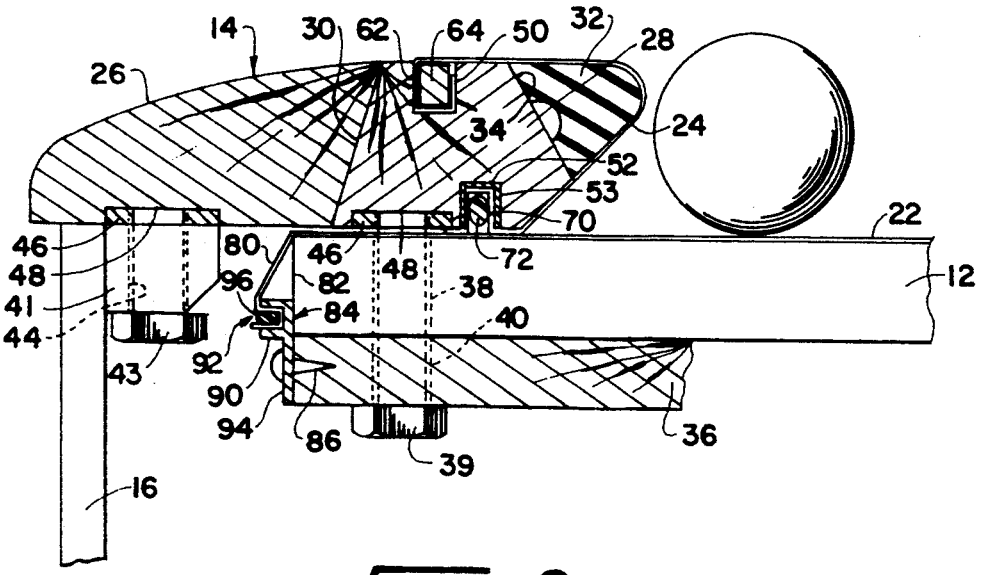
FIG. 2 is a cross sectional view of a side rail and horizontal playing surface that employ the system of this invention.

As depicted in FIG. 2, a representative rail element 14 includes a pair of elongate wooden segments 26 and 28 that are permanently joined by an appropriate adhesive applied between joint 30. A conventional pool table cushion 32 is secured by known means to surface 34 of wooden segment 28. Each rail element is interconnected in a known manner between pairs of side pockets 15, such as are shown in FIG. 1.

Figure 4:
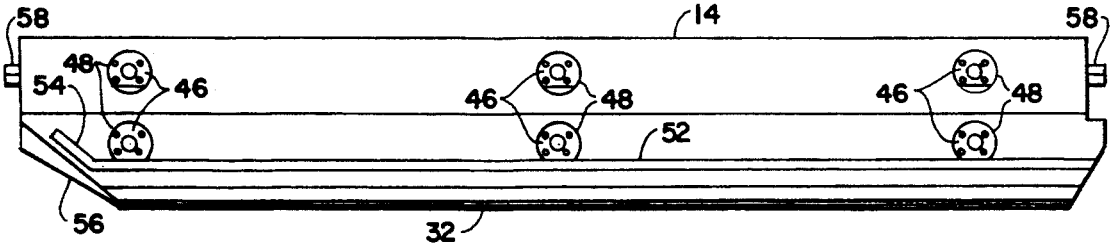
FIG. 4 is a bottom plan view of an adjacent side rail segment prior to the cloth cover being attached.

Playing surface 12 comprises a slate table top that carries a wood backing 36. The bottom surface of rail element 14 includes a plurality of longitudinally spaced circular recesses 48 that receive respective flat plates 46. Each plate is secured by appropriate screws or other conventional means within its respective recess. The longitudinal series of recesses 48 and plates 46 are best shown in FIG. 4. As shown in FIG. 2, a conventional bolt 39 is inserted through respective aligned openings 38 and 40 received through backing 36 and playing surface 12. Each bolt is threadably engaged with a complementary one of the plates 46 formed in wooden segment 28 of rail element 14. As a result, the rail element is secured to playing surface 12 in a manner known in the art. Skirt 16 carries a plurality of bushings 41 at its upper end. Each bushing has an opening 44 that is aligned with a complementary opening in one of the second longitudinal series of plates 46. A bolt 43 is threadably engaged with each one of the receptacles 44 and its aligned plate 46. As a result, skirt 16 is attached to and depends from the outer edge of rail 14. Once again, the manner of securing the skirt to the rail element will be known to those skilled in the art.

Figure 3:
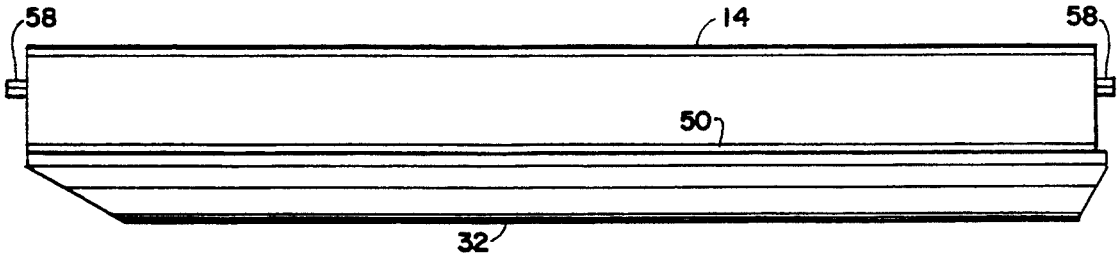
FIG. 3 is a top plan view of a side rail segment prior to a cloth cover being attached.

Each rail element 14 includes a first elongate groove 50 that is routed in the upper surface of segment 28 and a second elongate groove 52 that is similarly routed in the bottom surface of segment 28. Grooves 50 and 52 are shown more completely in the rail elements depicted in FIGS. 3 and 4, respectively. Groove 50 extends for generally the entire length of rail element 14. Groove 52 extends from one end of the rail element and includes an angled portion 54 that is formed generally parallel to the angled cushioned edge segment 56 of the rail element. The depth and width of grooves 50 and 52 are such that the grooves will receive featherstrips and channels, described below, in a relatively tight fit. A plurality of conventional metal plates 46 are received in respective recesses within the bottom surface of rail element 14. As previously described, these plates include threaded recesses for receiving bolts to secure the skin to the rail element and the rail element to the playing surface. The plates 46 that are positioned closest to cushioned edge 32 are cut such that they are generally semi-circular in shape. As a result, those plates do not interfere with groove 52. The ends of each rail element 14 include respective bolts 58 that enable the rail element to interengage with the pockets at each end thereof. Again, this is a conventional means of attachment in the billiards and pool table art.

Figure 5A:
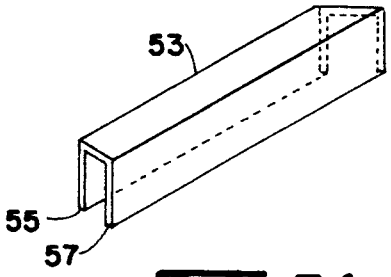
FIG. 5A is a perspective view of a piece of the channel member employed in the rail segment.

As best shown in FIG. 2, grooves 50 and 52 include generally rectangular configurations. Groove 52 receives a complementary shaped channel member 53, shown inserted in FIG. 2 and alone in FIG. 5A. More particularly, channel member 53 is composed of a sturdy metallic material such as stainless steel or aluminum. It has a generally U-shaped cross sectional shape and is sufficiently deep such that the edges 55 and 57 of channel member 53 are level with the bottom surface of segment 28 when the channel member is received by groove 52. The channel member is secured within groove 52 by staples, adhesive or other suitable means.

Upper groove 50 receives an upper section 62 of rail cloth 24. The upper portion of the rail cloth is held securely in place within groove 50 by an elongate wood featherstrip spline 64. In particular, upper cloth section 62 is wrapped about featherstrip 64 and the featherstrip is hammered or otherwise inserted into groove 50. The dimensions of featherstrip 64, cloth section 62 and groove 56 are such that the featherstrip and cloth are compressed to fit into groove 50 in a relatively tight or snug compression fit. Featherstrip 64, which is preferably composed of poplar or a similar wood material, is formed to be slightly narrower than the width of the groove 50. The clearance depicted in FIG. 2 is exaggerated for purposes of illustrating the construction of this invention. Rail cloth 24 extends about and out of groove 50. The cloth cover is wrapped snugly about cushion segment 32 and extends between segment 28 of rail element 14 and playing surface 12.

Figure 6:
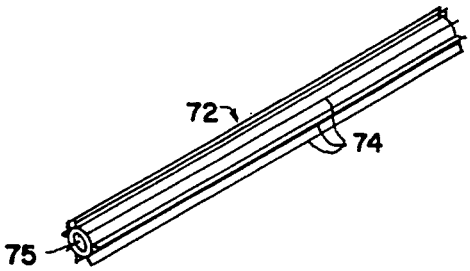
FIG. 6 is a partial perspective view of an elastomeric spline that secures the cloth cover in the channel member.

A lower section 70 of cover 24 is received by channel member 53 and is secured therein by an elongate elastomeric spline 72, shown alone in FIG. 6. The spline may comprise rubber or various other synthetic or natural materials and preferably includes elongate longitudinal ribs 74 which facilitate its use. Spline 72 may have a hollow axial center 75. Alternatively, a solid spline may be utilized. The spline is engaged with the channel member by conventional means such as a spline roller. A quarter inch spline is preferred although various sizes of splines and channel members may be employed. Spline 72 has a diameter which is slightly larger than the width of the opening in channel member 53. As a result, the spline may be inserted into the channel member in a relatively tight fit such that the lower section 70 of cloth 24 is held securely within the channel member. Featherstrip 64 and spline 72 hold the opposite end portions 62 and 70 of cover 24 snugly to provide the cover with a smooth, wrinkle-free appearance over at least the cushion portion 32 of the rail.

In contrast to a routed wooden channel, metallic channel member 53 does not substantially or significantly vary in size with temperature and humidity fluctuations. As a result, a constant snug and secure fit is provided and cloth cover 24 does not loosen. Moreover, the use of channel member 53 eliminates the need for extreme precision in routing groove 52. If a separate channel member is not used, the groove must be precisely cut. Otherwise, a sloppy fit and a loose cover may result.

Figure 5B:
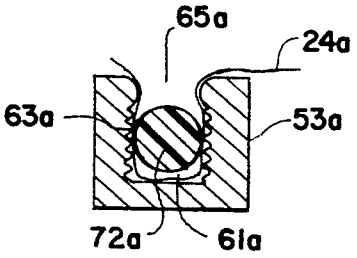
FIG. 5B is a cross sectional view of an alternative preferred channel member with a lower segment of the rail cloth and an elastomeric spline received therein.

An alternative preferred channel member **53*a* is shown in FIG. 5B. This channel member includes an interior channel 61*a* that is lined by teeth or serrations 63*a*. An entry 65*a* to channel member 53*a* is narrower than interior channel 61*a*. Spline 72*a* includes a diameter that is somewhat smaller than the width of entry 65*a*. As a result, the rail cloth 24*a* is secured in place in channel member 53*a* by squeezing spline 72*a* through entry 65*a* and into interior channel 63*a* by means of a spline roller or the like. The spline is held securely therein and loosening or slippage of rail cover 24*a*** is prevented.

Rail cloth 24 may be quickly and conveniently removed and replaced in the following manner. Initially, the entire rail 14 is removed from the table by disengaging the bolts 39. Spline 72 and featherstrip 64 are then removed from channel member 53 and groove 50, respectively. Next, the old cloth is removed and a new piece of cloth 24 is wrapped about cushion portion 32 of rail element 14. The upper and lower end portions of cloth 24 are inserted into groove 50 and channel member 53, respectively. More particularly, the upper portion of the cloth member is wrapped about the featherstrip 64, which is then hammered or otherwise urged back into groove 50. Finally, the lower portion of the replacement rail cloth is inserted into channel member 53 and pulled taut. Finally, spline 72 is replaced in channel member 53 to lock the new rail cloth in place.

Cloth 22, which extends across playing surface 12, includes a side portion 80 that depends over the edge 82 of the playing surface. A metal bracket 84 having a backwards F-shaped cross section is mounted to wooden backing 36 by means of screws 86, only one of which is shown. A plurality of such screws are formed through respective openings in flange 94 of bracket 84 at selected intervals along the bracket and the table. Preferably, bracket 84 extends along the side of the playing surface between adjacent pairs of pockets in the table. Various other means of attachment may be employed, although screws are preferred because they permit the bracket to be readily removed, replaced and repositioned, as required.

Bracket 84 includes a portion 90 that defines an elongate channel 92. Flange 94 extends from channel portion 90 and engages the sides of backing 36 and playing surface 12. This flange provides bracket 84 with improved stability.

Side portion 80 of cloth cover 22 is pulled taut, received within the channel 92 and held therein by an elastomeric spline 96. The spline may be composed of various elastomeric materials such as rubber, plastic, etc. and may resemble the spline depicted in FIG. 6. A similar bracket and spline arrangement is provided on the opposite side of the table for securing the opposite side of cloth cover 22. Two such complementary pairs of brackets and splines are provided along the sides of the table and a third pair of brackets and splines secure the cloth at the ends of the table.

As with the rail cover, the playing surface cover 22 may be installed, removed and replaced quickly and conveniently. To replace cloth cover 22, the rails are first removed, as previously described. Next, the splines 96 are removed from their respective brackets 84 and the cloth is pulled from the table. A new cloth of adequate size is replaced over the horizontal playing surface and the edges of the cloth are introduced into the channels 92 of respective brackets 84. More particularly, a speed clamp (not shown) holds one edge of the cloth taut, and the installer inserts and splines the opposite side into its respective bracket channel. Each segment of the cloth between a pair of pockets is then sequentially introduced and splined into its corresponding bracket such that a smooth taut cover is achieved. Alternatively, the installer may use a partner in place of a speed clamp for holding the opposite edge of the cloth taut. Appropriate cuts are made which correspond to the pockets and the edges of the cloth around those pockets are stapled to the pockets in a known manner. In other embodiments, a curved channel member is installed within each pocket to receive the cloth and a locking spline. This totally eliminates the need for staples.

Figure 7:
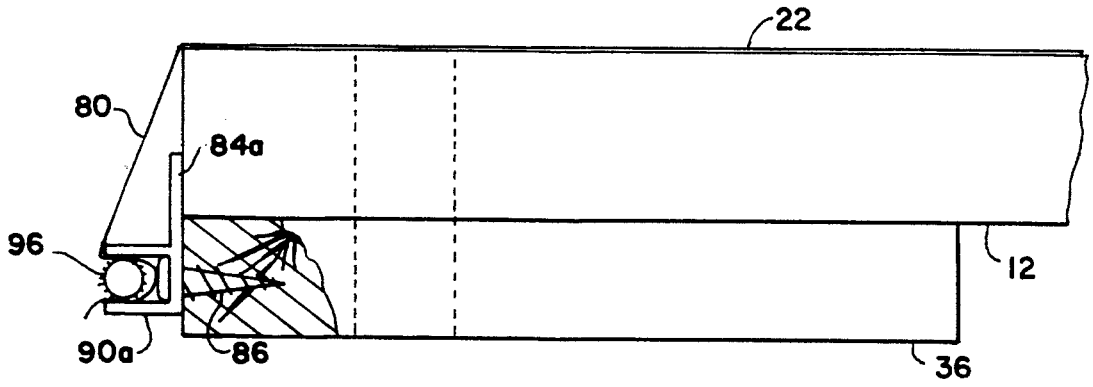
FIG. 7 is an elevational, cross sectional view of an alternative bracket configuration used to attach the cloth cover to the horizontal playing surface.
Figure 8:
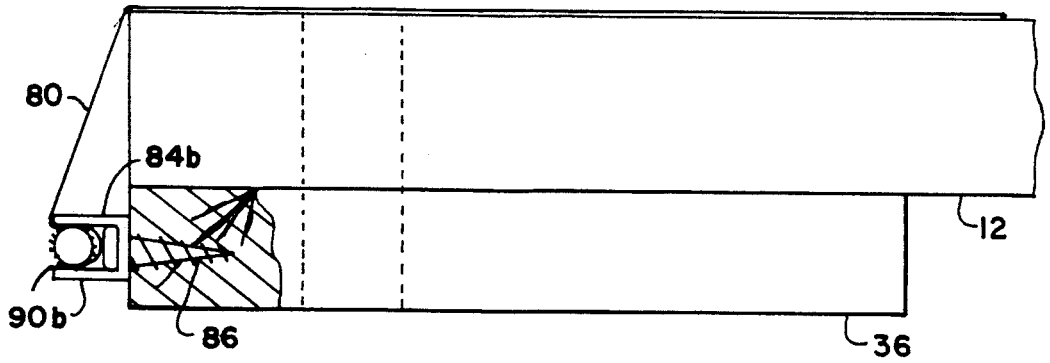
FIG. 8 is an elevational cross sectional view of an additional alternative preferred bracket for securing the cloth cover to the horizontal playing surface.
Figure 9:
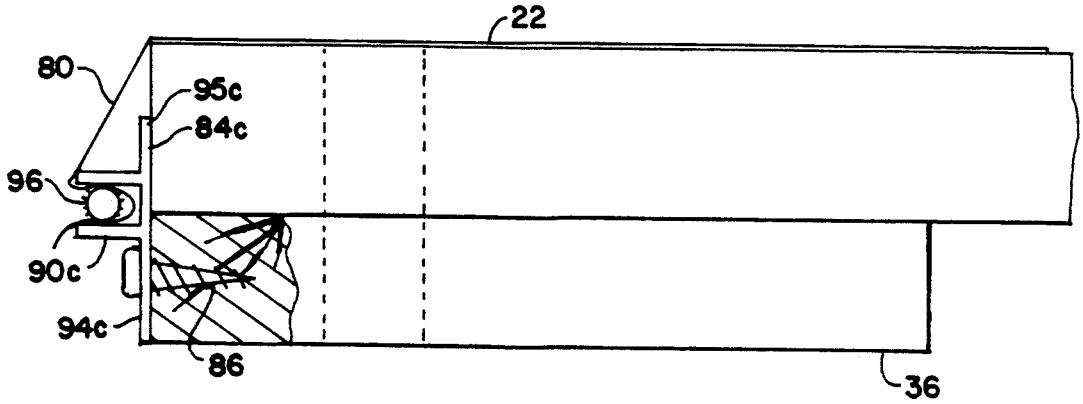
FIG. 9 is an elevational, cross sectional view of still another preferred bracket for use in connection with the horizontal playing surface cover.

Various alternative brackets for securing the playing surface cover to the table are shown in FIGS. 7–9. In FIG. 7, bracket **84*a* includes an inverted, backwards F-shaped cross section similar to that of previous embodiment. Bracket 84*a* is secured to backing 36 by screws 86 that extend through channel portion 90. As a result, channel portion 90 is positioned somewhat lower than in the previous embodiment adjacent to backing 36. As in the prior embodiment, spline 96 secures side portion 80 of cover 22** within the bracket channel.

Bracket **84*b*, FIG. 8, includes only a channel portion 90*b* for receiving cloth portion 80 and spline 96, and does not include any flanges. As in the embodiment of FIG. 2, screws 86 are secured to backing 36 through openings formed in the base of the channel member 90*b*. Bracket 84*b*** requires less material than in the other embodiments. However, because it lacks flanges, it is slightly less stable.

Bracket **84*c*, FIG. 9, includes a pair of flanges 94*c* and 95*c* that extend laterally from channel portion 90*c*. Screws 86 are secured to the backing 36 through holes in flange 94*c*. Again, the lower end 80 of cloth cover 22 is received by the channel member 90*c* and secured therein by a spline 96. The embodiment of FIG. 9** features a bracket requiring the greatest amount of material. However, that embodiment also provides the greatest amount of stability along the side of the table.

The brackets employed for securing the playing surface cloth to the table provide a significant advantage over conventional staples. It is much easier to remove and replace the cloth utilizing such brackets and splines. Many less man hours are required, both in the set up of new pool tables and the subsequent recovering and/or rehabilitation of old tables. Again, metallic brackets are preferred because these brackets yield particular advantages. As with the metal channel member, they do not vary in size with changing temperature and humidity. As a result, a constant, reliable fit is achieved. The use of brackets also eliminates the time and effort required for routing channels in the backing. Moreover, the channel brackets of this invention may be adjusted in position to improve the fit of the cover. Such a benefit cannot be achieved if permanent routed grooves or channels are used.

The channels may be cast, molded or formed using other known manufacturing techniques. Although metallic brackets and channel members are preferred, various other natural and synthetic materials may be utilized. Such materials should be resistant to expansion and contraction resulting from fluctuations in temperature and humidity.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A system for covering the elongate rail element mounted along the edge of a pool or billiards table, said system comprising:

a cloth cover that is wrapped about an inside, cushioned edge of said rail element, said cover including upper and lower sections;

an upper groove formed longitudinally in an upper surface of said rail element for receiving said upper section of said cover;

first spline means that are received in a relatively tight fit in said upper groove to hold said upper section of said cover therein;

a lower groove formed longitudinally in a bottom surface of said rail element; an elongate channel member that is received by and attached within said lower groove for receiving said lower section of said cover; and second spline means that are received in a relatively tight fit in said channel member to hold said lower section of said cover therein.

2. The system of claim 1 in which said first spline means include an elongate featherstrip.

3. The system of claim 1 in which said channel member has a generally U-shaped cross sectional shape.

4. The system of claim 1 in which said channel member is composed of a metallic material.

5. The system of claim 1 in which said second spline means include an elongate member.

6. The system of claim 5 in which said elastomeric member includes a plurality of longitudinal ribs.

7. The system of claim 1 in which said channel member includes a main channel and an entrance into said main channel, which entrance is narrower than said main channel.

8. A system for covering the horizontal playing surface of a pool table, said system comprising:

a cloth cover that extends across the playing surface of the pool or billiards table and includes a side portion that hangs over an edge of the playing surface;

a bracket that is attached to a backing element carried below the playing surface, said bracket having a channel that extends in a direction generally parallel to the edge of the playing surface for receiving said side portion of said cover; and spline means received by said channel in a relatively tight fit to hold said side portion of said cover in said channel.

9. The system of claim 8 in which said channel has a generally U-shaped cross sectional shape.

10. The system of claim 8 in which said bracket includes a portion that defines said channel and a flange portion that extends laterally from said channel portion and engages at least one of said backing element and a side of said playing surface.

11. The system of claim 10 in which said flange portion includes a single flange segment extending from one side of said channel portion.

12. The system of claim 10 in which said flange portion includes a pair of flange elements extending from respective sides of said channel portion.

13. The system of claim 8 in which said spline means include an elongate elastomeric member.

14. In a pool or billiards table, a system for covering the elongate rail element mounted along the edge of the table and the horizontal playing surface of the table, said system comprising:

a cloth that is wrapped about an inside, cushioned edge of said rail element, said system comprising;

a cloth cover that is wrapped about an inside, cushioned edge of said rail element, said covering including upper and lower sections;

an upper groove formed longitudinally in an upper surface of said rail element for receiving said upper section of said cover;

first spline means that are received in a relatively tight fit in said upper groove to hold said upper section said rail cover therein;

a lower groove formed longitudinally in a bottom surface of said rail element; an elongate channel member that is received by and attached within said lower groove for receiving said lower section of said rail cover;

second spline means that are received in a relatively tight fit in said channel member to hold said lower section of said rail cover;

a cloth playing surface cover that extends across the playing surface of the pool table and includes a side portion that hangs over an edge of the playing surface;

a bracket that is attached to a backing element carried below the playing surface, said bracket having a channel that extends in a direction generally parallel to the edge of the playing surface for receiving said side portion of said playing surface cover; and third spline means received by said bracket channel in a relatively tight fit to hold said side portion of said playing surface cover in said bracket channel.

15. The system of claim 14 in which said bracket is removably attached to said backing element.

* * * * *